US006029492A

United States Patent [19]

Müller et al.

[11] Patent Number: 6,029,492

[45] Date of Patent: Feb. 29, 2000

[54] FINE STEEL OR WIRE TRAIN WITH ROUGHING TRAIN, INTERMEDIATE TRAIN AND MULTIPLE-STAND FINISHING BLOCK

[75] Inventors: Hubert Müller, Grevenbroich; Rüdiger Grimmel, Nephen; Karl Keller, Hilchenbach; Klaus Hoffmann, Düsseldorf, all of Germany

[73] Assignee: SMS Schloemann-Siemag Aktiengesellschaft, Düsseldorf, Germany

[21] Appl. No.: 09/263,584

[22] Filed: Mar. 6, 1999

[30] Foreign Application Priority Data

Mar. 7, 1998 [DE] Germany ..... 198 09 917

[51] Int. Cl.[7] ..... B21B 31/07; B21B 35/00

[52] U.S. Cl. ..... 72/249

[58] Field of Search ..... 72/224, 234, 235, 72/237, 238, 239, 249

[56] References Cited

U.S. PATENT DOCUMENTS

| | | | |
|---|---|---|---|
| 2,002,266 | 5/1935 | Kral | 72/235 |
| 2,972,916 | 2/1961 | Morgan | 72/249 |
| 3,992,915 | 11/1976 | Hermes et al. | 72/249 |
| 4,408,474 | 10/1983 | Hutzenlaub et al. | 72/249 |
| 5,619,880 | 4/1997 | Polster et al. | 72/235 |

FOREIGN PATENT DOCUMENTS 0114793 8/1984 European Pat. Off. .

*Primary Examiner*—Rodney A Butler

*Attorney, Agent, or Firm*—Friedrich Kueffner

[57] ABSTRACT

A fine steel or wire train with a multiple-stand roughing train, a multiple-stand intermediate train and a finishing block composed of six or eight or ten roll stands with a common drive, wherein at least the two last roll stands of the finishing block are each provided with an individual drive unit and the drive shafts of the last two roll stands which can be uncoupled intersect the principal drive shafts of the coupled stands.

4 Claims, 5 Drawing Sheets

FINE STEEL OR WIRE TRAIN WITH ROUGHING TRAIN, INTERMEDIATE TRAIN AND MULTIPLE-STAND FINISHING BLOCK

BACKGROUND OF THE INVENTION

1. Field of the Invention

The present invention relates to a fine steel or wire train with a multiple-stand roughing train, a multiple-stand intermediate train and a finishing block composed of six or eight or ten roll stands with a common drive.

2. Description of the Related Art

Finishing blocks are conventionally composed of six, eight or ten roll stands with a common drive. This causes the ratios of the rates of rotation of the stands relative to each other and, thus, also the decreases in the individual stands to be fixed.

A modern fine steel or wire train is to be constructed in such a way that it can meet the actual requirements with respect to capacity and product quality. It is of essential importance in this connection that an internationally competitive final product is produced. In the field of wire production, one of the requirements is that tolerances of up to ±0.1 mm are to be maintained and a high degree of flexibility is available when the rolling program is changed.

These high requirements made of the final product can only be met when using the most modern plant technology.

DE-O 114 793 A2 discloses a rolling block for high speeds with, for example, eight H/V stands, wherein, for driving four groups of stands, two drive units which are in kinematic connection through spur gear units and provided with a motor each are provided.

SUMMARY OF THE INVENTION

Therefore, it is the primary object of the present invention to provide a structural further development of a finishing block in which the reduction in the last two passes can be varied, so that, on the one hand, different final dimensions of a rolled product can be rolled with the same exiting cross-section of the preceding stands, and which makes it possible, on the other hand, to finish-roll a rolling stock which emerges from the intermediate train with cross-section differences while maintaining strict final cross-sectional tolerances.

In accordance with the present invention, at least the two last roll stands of the finishing block are each provided with an individual drive unit and the drive shafts of the last two roll stands which can be uncoupled intersect the principal drive shafts of the coupled stands.

Due to the fact-that in a finishing block with a conventional group drive of the existing six, eight or ten roll stands, the last two stands are each equipped with an individual drive unit, there is the significant advantage that the reduction in the last two passes can be varied, so that, on the one hand, different final dimensions can be rolled with the same initial cross-section from the preceding stands, and finish-rolling is possible, on the other hand, with rolling stock emerging from the intermediate train with cross-section differences while maintaining strict final cross-sectional tolerances.

In accordance with a further development of the invention, the drive shafts of the individual drive units are constructed with transverse drive shafts which intersect the longitudinal drive shafts of the group drive and are connected so as to interact kinematically through bevel gear units of the same type with individually driveable rolls.

In the interest of a high flexibility of the rolling program, it is advantageous if at least the individually driveable stands of the finishing block are equipped with devices for a rapid exchange of the rolls.

In accordance with another important feature of the present invention, each of the individually driveable stands is provided with an individual drive unit which includes a motor each, an individual gear unit and an adapter gear unit.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
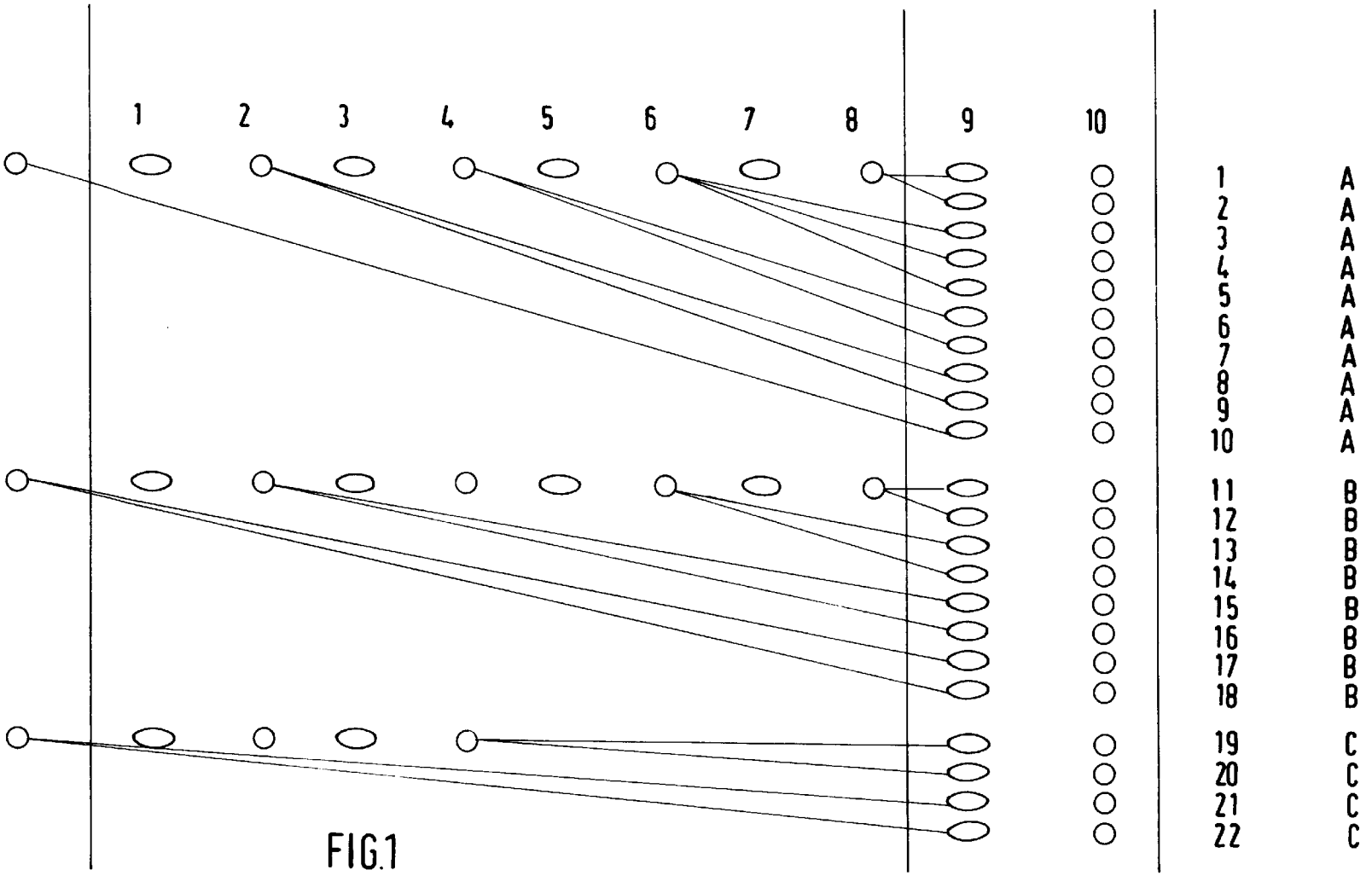
FIG. 1 is a diagram showing possible pass sequences.

The diagram of FIG. 1 shows by way of example, starting from an exiting cross-section from the intermediate train, possible pass sequences in a finishing block having altogether eight stands which are commonly driven and two last stands which are each provided with individual drive units. The diagram shows that the reduction in the last two passes can be varied in such a way that various desired final dimensions can be rolled with the same or slightly different exit cross-section from the exit of the intermediate train. It is possible in this manner to roll a program of exactly predetermined final dimensions even though it has to be accepted that the slight additional expense for the individual drive units is required.

Figure 2:
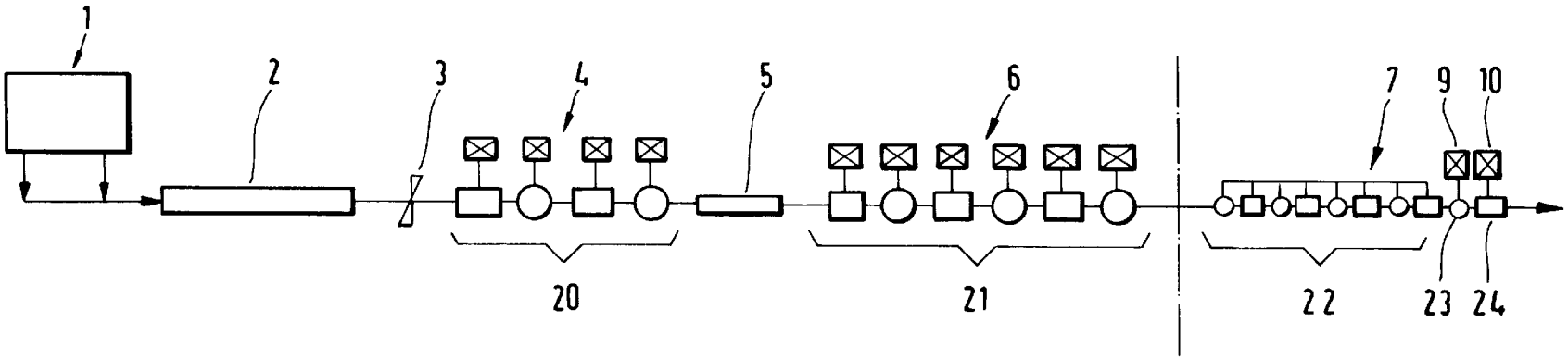
FIG. 2 is a schematic illustration of a rolling plant according to the present invention.

FIG. 2 is a schematic illustration of a rolling plant with a billet furnace 1, an equalizing furnace 2 a shear 3, a roughing train 4 with four H/V stands 20, followed by a water box 5 and a subsequently arranged intermediate train 6 with six individual stands 21 each having separate drive units. A finishing block 7 follows the intermediate train 6. The finishing block 7 has eight stands 22 which are provided with a common drive unit. The stands 22 of the finishing block 7 are followed by two stands 23 and 24 which, in accordance with the present invention, are each provided with an individual drive 9 and 10, respectively.

Figure 3:
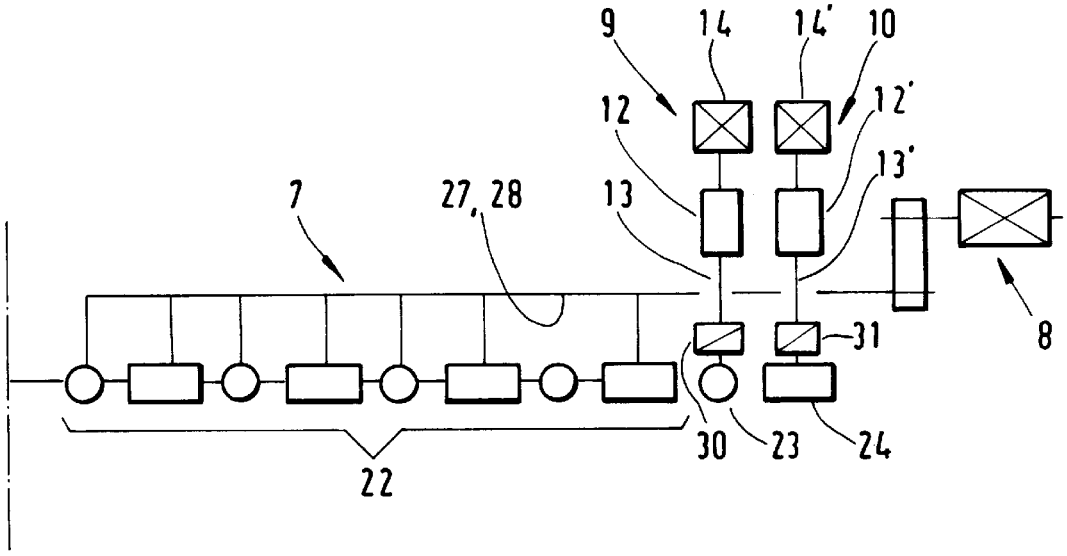
FIG. 3 is a schematic illustration, on a larger scale, of the finishing block of the rolling plant of FIG. 2 including the last two individual stands.

FIG. 3 shows the finishing block 7 on a larger scale. The finishing block 7 includes the last two stands 23 and 24 with the individual drives 9 and 10, respectively, which each have horizontal drive shafts 13 and 13'. The drive shafts 13 and 13' intersect the longitudinally extending drive shafts 27, 28 which are provided for the group drive 8 of the finishing block 7. Each of the last two stands 23 and 24 is provided with an individual motor 14, 14', a bevel gear unit 30, 31 and an adapter gear unit 12, 12'.

Figure 4A:
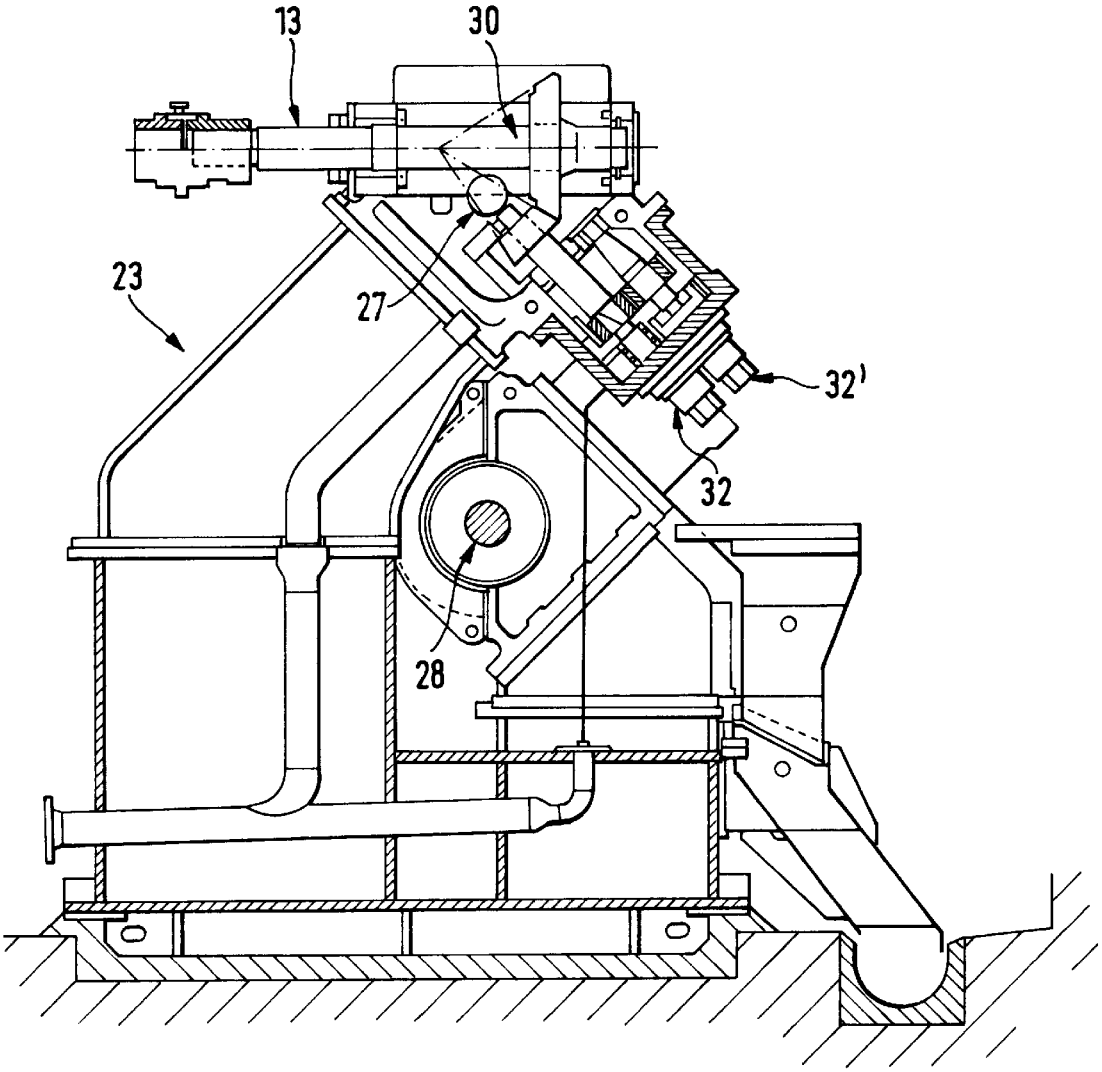
FIGS. 4*a* and 4*b* are schematic illustrations of individual drives for the last two stands of the finishing block.
Figure 4B:
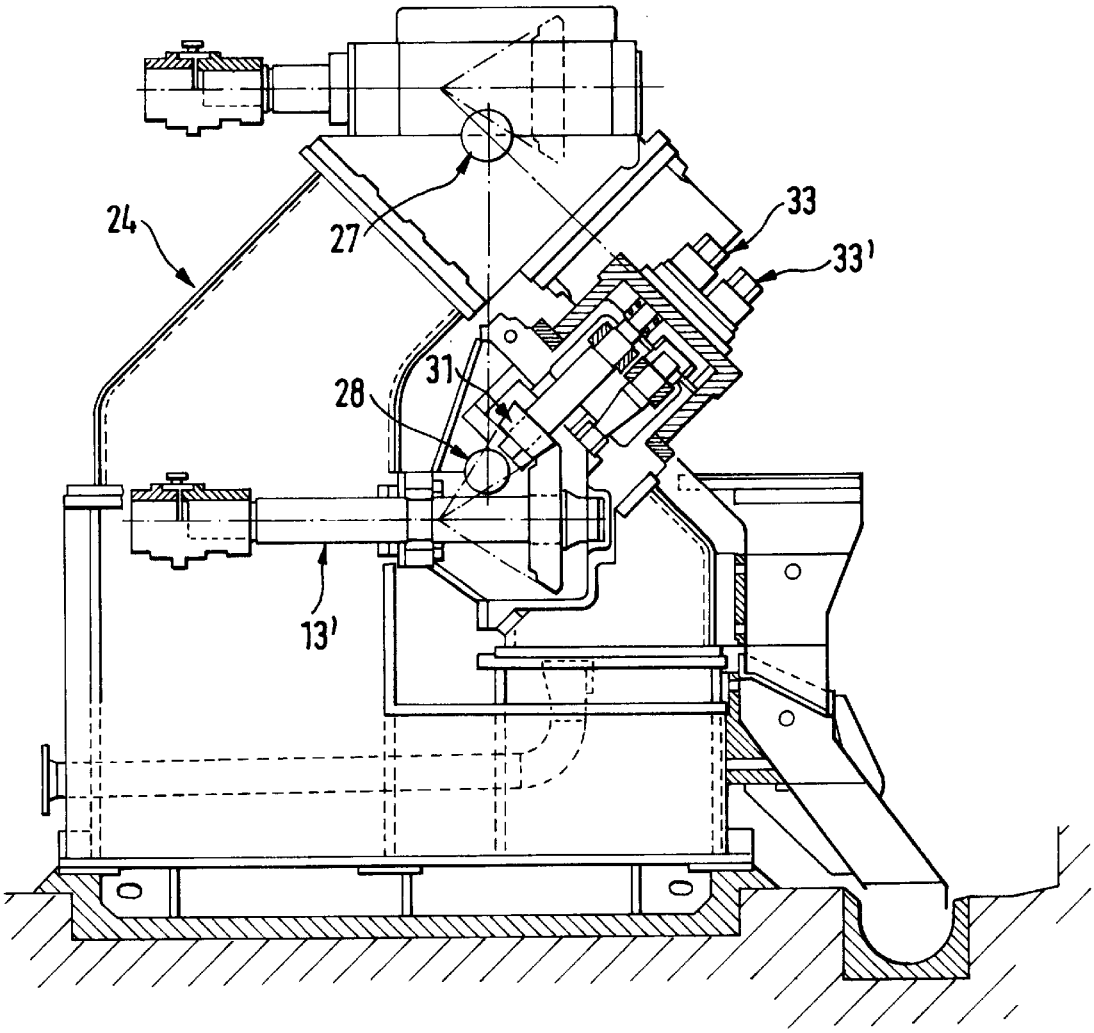

The structural configuration of the stands 23 and 24 is illustrated in detail in FIGS. 4*a* and 4*b*. The stands 23, 24 preferably have horizontally arranged drive shafts 13 and 13' which are connected so as to kinematically interact through bevel gear units 30, 31 to the individually driveable rolls 32, 33. Rolls 32', 33' are arranged in the conventional manner so as to be driven by the rolls 32, 33. As schematically illustrated in FIG. 4*b*, devices 35 for effecting rapid exchanges of the rolls of the stands 23 and 24 may be provided.

In accordance with the structural configuration of the present invention, the drive shafts 13, 13' of the individual drive units 9, 10 are constructed as transversely extending drive shafts which intersect the longitudinally extending drive shafts 27, 28 of the common group drive. In view of the drive of the longitudinal drive shafts 27, 28 from the exit side of the finishing block 7, the drive shafts 13, 13' are arranged so as to intersect the longitudinal drive shafts 27, 28.

While specific embodiments of the invention have been shown and described in detail to illustrate the inventive principles, it will be understood that the invention may be embodied otherwise without departing from such principles.

We claim:

1. A fine steel or wire rolling train comprising a multiple-stand roughing train, a multiple-stand intermediate train following the roughing train and a finishing block equipped with six or eight or ten roll stands following the intermediate train, the roll stands of the finishing train including two last roll stands each equipped with an individual drive unit with a drive shaft, wherein the roll stands of the finishing block preceding the last two roll stands are coupled to each other through principal drive shafts, and wherein the drive shafts of the individual drive units of the last two roll stands intersect the principal drive shafts of the stands of the finishing train preceding the last two trains.

2. The rolling train according to claim 1, wherein the drive shafts of the stands of the finishing train preceding the last two stands extend in a longitudinal direction and the drive shafts of the individual drive units of the last two stands intersect and extend transversely of the longitudinally extending drive shafts, wherein each of the last two stands has a driven roll, and wherein each individual drive unit of the last two stands is kinematically connected to the roll through a bevel gear unit of the same type.

3. The rolling train according to claim 1, wherein each of the individual drive units for driving a roll of the last two stands comprises a motor, a bevel gear unit and an adapter gear unit connected between the motor and the bevel gear unit.

4. The rolling train according to claim 2, further comprising devices for effecting rapid exchanges of the rolls of the last two stands of the finishing block.

* * * * *